US008133094B2

(12) United States Patent
Loveless et al.

(10) Patent No.: US 8,133,094 B2
(45) Date of Patent: Mar. 13, 2012

(54) DUST SHROUD WITH ACCESS HATCH RETENTION MECHANISM

(75) Inventors: Michael Loveless, Price, UT (US); Spencer Loveless, Price, UT (US); Ryan Anderson, Chicago, IL (US)

(73) Assignee: Dust Collection Products, LLC, Price, UT (US)

( * ) Notice: Subject to any disclaimer, the term of this patent is extended or adjusted under 35 U.S.C. 154(b) by 538 days.

(21) Appl. No.: 12/357,272

(22) Filed: Jan. 21, 2009

(65) Prior Publication Data

US 2009/0186559 A1 Jul. 23, 2009

Related U.S. Application Data

(60) Provisional application No. 61/022,457, filed on Jan. 21, 2008.

(51) Int. Cl.
*B24B 1/00* (2006.01)

(52) U.S. Cl. ..... 451/28; 451/451; 451/453; 451/456; 451/457

(58) Field of Classification Search ..... 451/451–457, 451/359, 353; 83/100; 30/124, 156; 403/326, 403/329; 24/3.12
See application file for complete search history.

(56) References Cited

U.S. PATENT DOCUMENTS 907,734 A 12/1908 Butterfield
1,123,562 A * 1/1915 Lund ..... 451/454
1,643,882 A 9/1927 Faiver
2,032,382 A * 3/1936 Torrison ..... 451/357
2,291,269 A 7/1942 Wiggleworth
2,478,074 A 8/1949 Atkin
2,503,854 A * 4/1950 Trainor ..... 403/223
2,520,725 A * 8/1950 Judd ..... 248/27.1
2,803,098 A * 8/1957 Downing et al. ..... 451/456
2,819,570 A 1/1958 Guilbert et al.
2,819,571 A 1/1958 Morgan
2,994,995 A 8/1961 Griffith
3,166,877 A 1/1965 Reames
3,468,076 A 9/1969 Jones
3,667,170 A 6/1972 MacKay
3,673,744 A 7/1972 Oimoen
3,835,543 A 9/1974 Polydoris et al.
3,862,521 A 1/1975 Isaksson
3,882,598 A 5/1975 Earle et al.
3,882,644 A 5/1975 Cusumano
4,002,182 A 1/1977 Michel
4,135,334 A 1/1979 Rudiger
4,253,362 A 3/1981 Olson
4,381,628 A 5/1983 Dicke
4,400,995 A 8/1983 Palm
4,574,532 A 3/1986 Haberle et al.
4,576,072 A 3/1986 Terpstra et al.
4,622,782 A 11/1986 Roestenberg
4,697,389 A 10/1987 Romine
(Continued)

FOREIGN PATENT DOCUMENTS

EP 556713 8/1993
(Continued)

*Primary Examiner* — George Nguyen
(74) *Attorney, Agent, or Firm* — Bateman IP; Randall B Bateman; Brett Peterson

(57) ABSTRACT

A vacuum shroud for an angle grinder includes a removable hatch for grinding in a corner and provides a storage location on the shroud for the hatch in order to encourage use of the hatch when not grinding in a corner.

15 Claims, 4 Drawing Sheets

U.S. PATENT DOCUMENTS 4,761,877 A 8/1988 Rupp
4,782,632 A 11/1988 Matechuk
4,868,949 A 9/1989 Loveless et al.
4,932,163 A 6/1990 Chilton et al.
4,932,164 A * 6/1990 Sullivan et al. ..... 451/359
5,033,552 A 7/1991 Hu
5,074,044 A 12/1991 Duncan et al.
5,084,972 A 2/1992 Waugh
5,105,585 A * 4/1992 Hampl et al. ..... 451/359
5,125,190 A * 6/1992 Buser et al. ..... 451/456
5,163,252 A * 11/1992 Garner et al. ..... 451/451
5,167,215 A 12/1992 Harding, Jr.
5,201,785 A 4/1993 Nagano
5,237,781 A * 8/1993 Demetrius ..... 451/456
5,327,649 A 7/1994 Skinner
5,339,571 A 8/1994 Timmons et al.
5,411,433 A * 5/1995 Keller ..... 451/451
5,440,809 A 8/1995 Padilla
5,545,082 A 8/1996 Courson et al.
5,558,571 A 9/1996 Toyoshima et al.
5,564,408 A 10/1996 Bassols
5,566,457 A 10/1996 Batschari et al.
5,575,035 A 11/1996 Reis et al.
5,588,213 A 12/1996 Swanberg
5,609,516 A 3/1997 Courson et al.
5,675,895 A 10/1997 Mori et al.
5,704,956 A 1/1998 Loveless et al.
5,713,785 A 2/1998 Nishio
5,774,992 A 7/1998 Lindenmuth
5,791,979 A 8/1998 Duncan et al.
5,816,733 A * 10/1998 Ishikawa et al. ..... 403/329
5,931,072 A 8/1999 Shibata
5,954,863 A 9/1999 Loveless et al.
6,027,399 A * 2/2000 Stewart ..... 451/353
6,053,674 A 4/2000 Thompson
6,108,912 A 8/2000 Radigan
6,138,317 A 10/2000 Holmes et al.
6,167,626 B1 1/2001 Doumani et al.
6,219,922 B1 4/2001 Campbell et al.
6,318,352 B1 11/2001 Gnazzo et al.
6,347,985 B1 2/2002 Loveless
6,471,574 B1 10/2002 Rupprecht et al.
6,557,261 B1 5/2003 Buser et al.
6,699,114 B1 * 3/2004 Booeshaghi et al. ..... 451/451
6,726,554 B1 4/2004 Chen et al.
6,748,660 B2 6/2004 Buser et al.
6,796,208 B1 9/2004 Jorgensen
6,811,476 B2 11/2004 Ohlendorf
6,855,040 B2 2/2005 Huber
6,860,799 B2 3/2005 Loveless
6,878,050 B2 4/2005 Wendt et al.
6,902,594 B2 6/2005 Cho
6,935,939 B1 8/2005 Buser et al.
7,047,650 B2 * 5/2006 Chen ..... 30/388
7,223,161 B2 5/2007 Kodani et al.
7,625,265 B2 12/2009 Woods et al.
7,635,293 B2 12/2009 Sun et al.
7,892,075 B2 * 2/2011 Esenwein ..... 451/451
2005/0088866 A1 4/2005 Levine
2006/0019585 A1 1/2006 Zayat
2007/0178815 A1 * 8/2007 Buser ..... 451/451
2007/0193759 A1 8/2007 Sweig et al.
2008/0099053 A1 5/2008 Loveless
2008/0109986 A1 5/2008 Loveless
2008/0200103 A1 * 8/2008 Esenwein ..... 451/455
2008/0271323 A1 11/2008 Perlmutter
2009/0181604 A1 7/2009 Loveless
2009/0181605 A1 7/2009 Loveless
2009/0181606 A1 7/2009 Loveless
2009/0183377 A1 7/2009 Loveless
2009/0183800 A1 7/2009 Loveless
2009/0186559 A1 7/2009 Loveless
2009/0311953 A1 12/2009 Maute et al.

FOREIGN PATENT DOCUMENTS

GB 2 260 721 4/1993
JP 10-000559 1/1998
KR 10-2002-0056086 7/2002

* cited by examiner

DUST SHROUD WITH ACCESS HATCH RETENTION MECHANISM

RELATED APPLICATIONS

The present application claims the benefit of U.S. Provisional Application Ser. No. 61/022,457, filed Jan. 21, 2008, which is expressly incorporated herein by reference in its entirety. The present application was developed subject to a joint research agreement between the Robert Bosch Tool Corporation and Dustless Depot, LLC.

BACKGROUND OF THE INVENTION

1. The Field of the Invention

The present invention relates to vacuum shrouds. More specifically, the present invention relates to vacuum shrouds for angle grinders which include an access hatch and a retention mechanism for the access hatch.

2. State of the Art

Dust shrouds are typically used to both contain grinding dust and prevent a mess as well as to protect an operator from debris, dust, and the grinding disc. These shrouds generally attach to an angle grinder between the grinder body and the grinding wheel. The shroud then forms a barrier between the operator and the grinding wheel. The shroud often extends around the edges of the grinding wheel, leaving the bottom grinding portion open for use. Thus, the dust shroud provides a dust and debris barrier and a safety barrier.

Some dust shrouds provide a vacuum attachment so that dust and debris can be suctioned out of the shroud. This avoids airborne dust and debris that can lead to such health problems as silicosis. The use of a vacuum also keeps the workplace clean of debris, dramatically reducing the time necessary to clean up after a grinding job. Vacuum dust shrouds are commonly used while grinding concrete. It can be appreciated how, without a shroud, a significant amount of concrete dust is spread across a wide area. With a vacuum shroud, very little dust goes uncollected. The use of a vacuum shroud can also protect the tool by preventing dust and debris from entering the motor and gears, thus extending tool life.

Effective vacuum shrouds often cover the top and entire perimeter of the grinding disc, such that most of the dust and debris is captured by the vacuum and the disc is not exposed to the operator. Complete enclosure of the perimeter of the grinding disc makes it difficult to use against a corner, such as when grinding a floor adjacent a wall.

Vacuum shrouds for grinders have been made which allow a user to remove a hatch portion of the shroud to expose a side of the grinding disk and allow grinding into a corner. It has been found, however, that workers tend to remove the hatch to grind a corner and either lose the hatch or neglect to replace the hatch after finishing the corner. The worker needs both hands for operating the grinder, and thus can not hold the hatch while grinding. It is not uncommon for workers to simply place the hatch in a toolbox or on the floor, and lose the hatch or simply not replace the hatch as is desired.

The failure to replace the hatch when not grinding a corner is more detrimental than one might think. In addition to the danger of having an exposed grinding disk, having an opening in the perimeter of the dust shroud allows a significant portion of the grinding dust to escape and not be collected by the vacuum. The dust from grinding concrete is very fine, and will float in the air for a long period of time, allowing uncollected dust to settle over a large area. Additionally, the dust contains compounds from the concrete which are harmful to the lungs, and uncollected dust poses more of a health risk to the worker and to others.

Thus there is a need for a grinder dust shroud with a removable corner grinding hatch which encourages workers to use the hatch. There is a need for a grinder shroud which allows a person to store an access hatch on the shroud itself when the hatch is removed from the shroud.

SUMMARY OF THE INVENTION

It is an object of the present invention to provide an improved vacuum shroud for angle grinders.

According to one aspect of the invention, the vacuum shroud has a removable hatch along an edge of the shroud. When the hatch is in place along the edge of the shroud, the shroud extends around the entire perimeter of the grinding disk. The hatch may be removed for using the grinding in a corner where the grinding disk must be placed immediately adjacent an object such as a wall. The shroud also includes a mount on the top of the shroud where the hatch may be stored when not in place on the edge of the shroud.

This and other aspects of the present invention are realized in an improved vacuum shroud as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
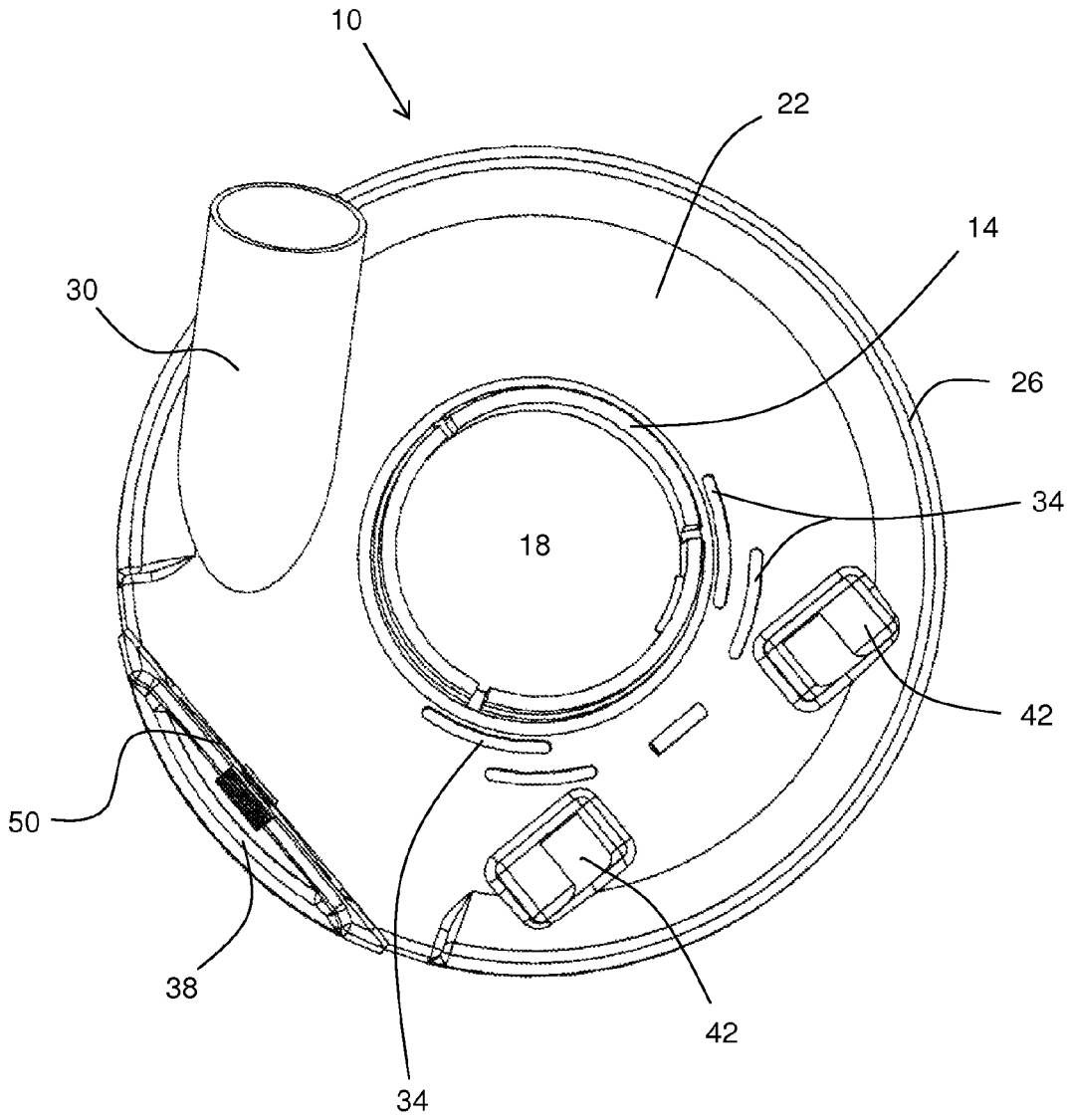
FIG. 1 shows a top view of a vacuum shroud of the present invention.

Turning now to FIG. 1, a top view of a shroud 10 of the present invention is shown. The shroud 10 is for use with an angle grinder, and as such includes a generally circular collar 14 or other attachment means for attaching the shroud to the angle grinder so that the output shaft of the grinder extends through the opening 18. The shroud 10 has a flat upper surface 22 and a continuous outer skirt 26 which extends downwardly from the upper surface to enclose a grinding disk which is attached to the grinder.

A vacuum port 30 is connected to draw air from around the grinding disk. Slots or holes 34 may be provided in the shroud to reduce the likelihood that an increased vacuum pressure within the shroud 10 will pull the grinding disk into the work surface during use. The vacuum port 30 is typically sized to receive a conventional 1.25 inch vacuum hose.

The shroud 10 includes a hatch 38 which may be removed to expose a portion of the grinding disk to allow grinding right up against an abutment, such as when grinding a concrete floor up against a wall. The shroud 10 includes at least one mount 42 on the upper surface 22 which is used to hold the hatch 38 when the hatch is removed from the closed position shown in FIG. 1. Preferably, a pair of mounts 42 are used.

As discussed, a significant problem arises when workers do not use the hatch because of the inconvenience of handling the hatch when not in a closed position, or because the hatch is lost. The mounts 42 provide a simple and convenient location to mount the hatch 38 when grinding in a corner, such as grinding a floor up against a wall, is necessary. The hatch 38 is stored on the shroud itself, making it easy to place the hatch in the closed position after grinding in a corner, and making it less likely that the hatch is lost.

Figure 2:
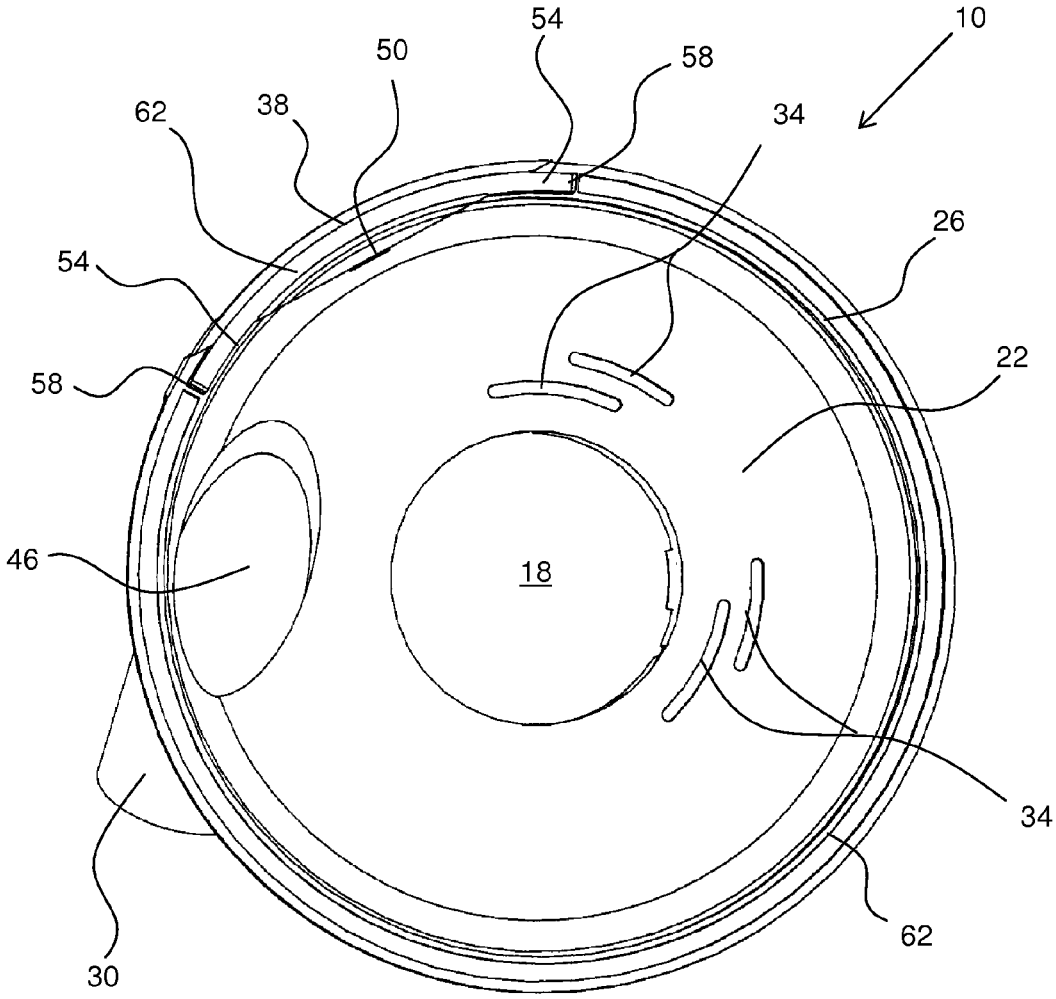
FIG. 2 shows a bottom view of the vacuum shroud of FIG. 1.

Turning now to FIG. 2, a bottom view of the shroud of FIG. 1 is shown. It can be seen how the vacuum port 30 has an opening 46 which allows the vacuum to draw debris from around the grinding disk. The hatch 38 separates from the shroud 10 at line 50 so that when the hatch is removed the edge of the grinding disk is exposed. The hatch 38 and shroud 10 have mating tabs 54 and notches 58 which secure the hatch to the shroud in a closed position. The hatch 38 and shroud 10 may include a groove 62 formed in their lower edge which holds bristles or the like to improve the performance of the shroud.

Figure 3:
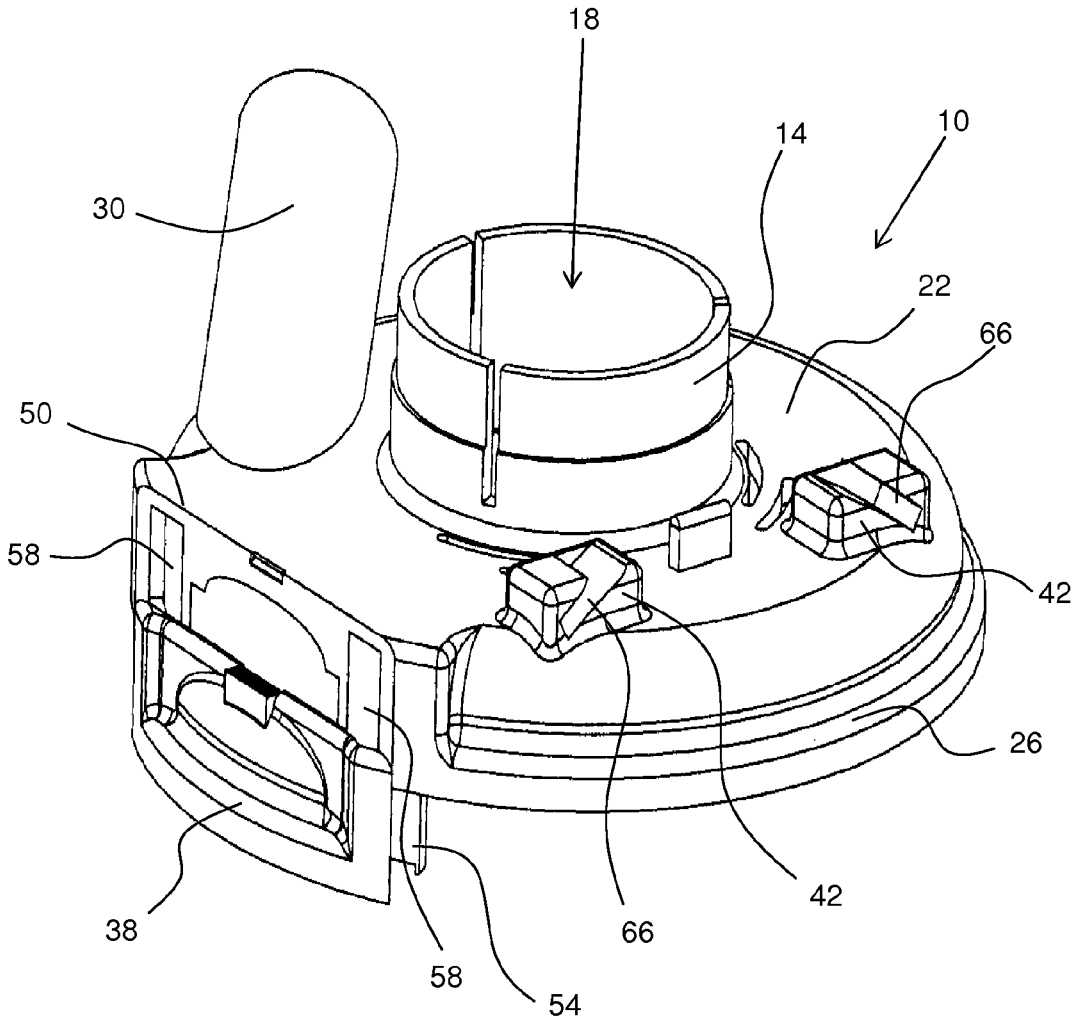
FIG. 3 shows a perspective view of the vacuum shroud of FIG. 1.

Turning now to FIG. 3, a perspective view of the shroud of FIG. 1 is shown. It can be better seen how the tabs 54 and notches 58 secure the hatch 38 to the shroud 10 in a closed position. As shown, the notches are formed on the shroud body. When the hatch 38 is removed for grinding in a corner, the hatch is placed into correspondingly shaped notches 66 formed in mounts 42 on the top surface 22 of the shroud 10. The hatch 38 is thus secured to the top of the shroud 10 while a person is grinding in a corner. Thus, the mounts 42 on top of the shroud 10 present notches 66 which are functionally identical to the notches 58 formed in the skirt 26 of the shroud, allowing the hatch 38 to be conveniently and securely mounted to the top of the shroud 10 in a storage position.

Figure 4:
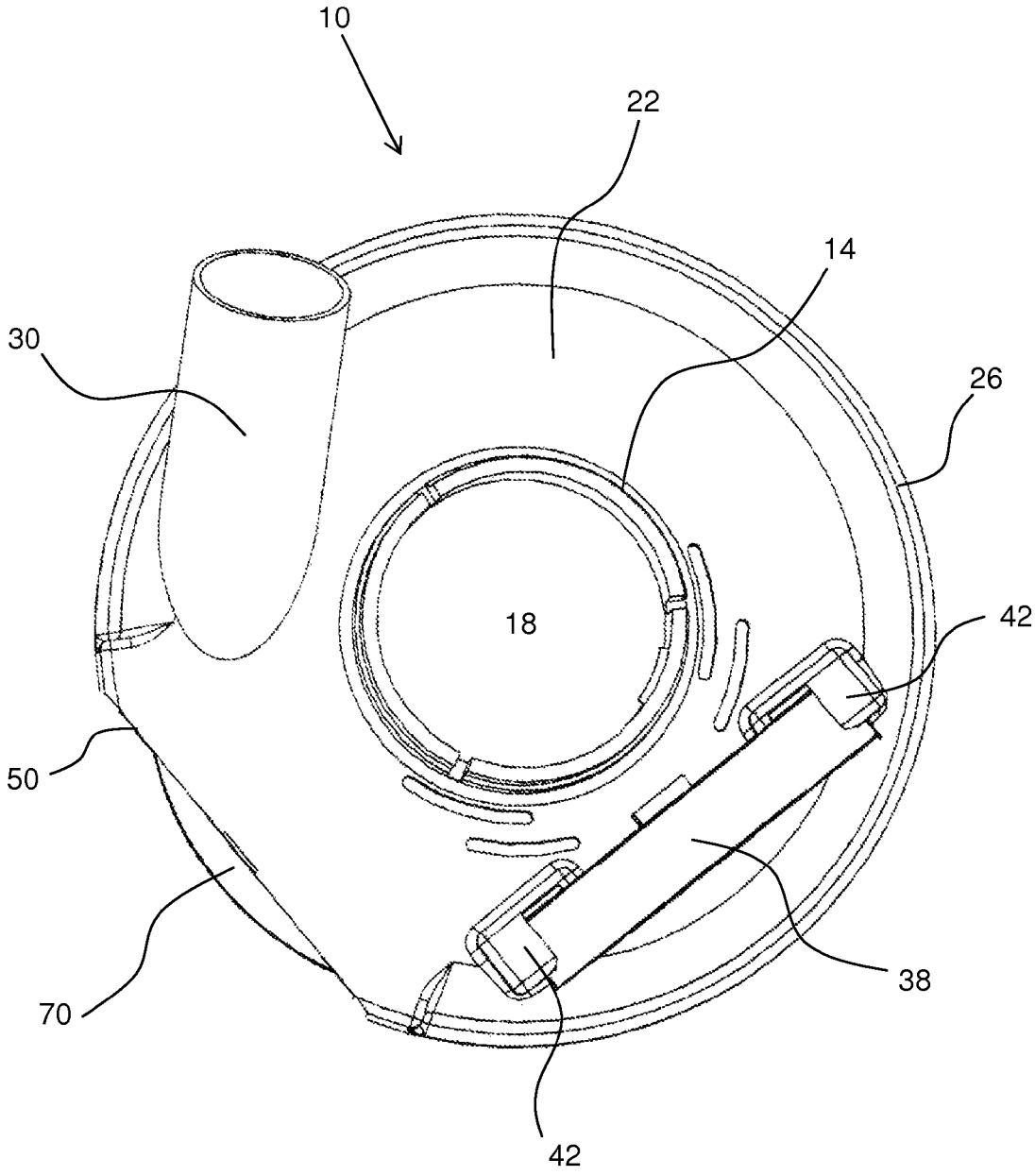
FIG. 4 shows another top view of the vacuum shroud of FIG. 1.

Turning now to FIG. 4, another top view of the shroud of FIG. 1 is shown. The hatch 38 is shown secured in the mounts 42 as would occur while grinding in a corner. When the hatch is attached to the mounts 42, a grinding disk 70 will protrude from the shroud 10, allowing a person to grind right up to a wall or the like. As is seen, the hatch 38 separates from the shroud body 22 along a line extending across the body 22. When the hatch 38 is removed, about 5 percent of the diameter of the grinding wheel 70 is exposed. It will be appreciated that it is not necessary to expose a large amount of the grinding wheel 70 in order to allow a person to grind in a corner such as up against a wall. Exposing much more of the grinding wheel than is necessary compromises the effectiveness of the shroud in capturing dust and debris.

It is quite easy to place the hatch in the mounts 42 and replace the hatch in the closed position after grinding in a corner. It is much easier to place the hatch in the mounts 42 rather than trying to hold the hatch or otherwise find the hatch where mounts 42 are not provided. The ease with which the mounts 42 may be used to store the hatch 38 will increase worker compliance in properly using the hatch when not grinding in a corner, and will reduce the incidence of lost hatches. This will, in turn, provide a significant safety benefit. Where the hatch 38 is used properly and replaced after use, the grinding disk 70 is properly covered during use, reducing the risk of injury to the worker. Additionally, where the hatch 38 is properly closed during use of the grinder, the shroud 10 is more effective at capturing debris, significantly reducing the un-captured debris while grinding as compared to where the hatch 38 is lost or discarded. This promotes a safer and cleaner working environment. As a significant market for angle grinder dust shrouds is for grinding concrete, effectively capturing the dust is very important. The fine dust will travel great distances if not captured and is difficult to clean. Of greater importance, however, is the health risk presented by the silica and mineral containing dust.

There is thus disclosed an improved dust shroud for use with angle grinders. It will be appreciated that numerous changes may be made to the present invention without departing from the scope of the claims.

What is claimed is:

1. A vacuum shroud for an angle grinder comprising:

a body having an upper surface and a skirt attached thereto and extending downwardly from the upper surface so as to define an interior space so as to generally enclose a grinding disk of an angle grinder in said interior space;

a hole formed in the center of the upper surface and a grinder mount located around the hole and extending upwardly from the upper surface for securing the shroud to an angle grinder;

a vacuum port attached to the body and disposed in fluid communication with the interior space of the body;

a removable hatch forming part of the skirt, the hatch being configured such that an edge of a grinding disk is exposed when the hatch is removed from the body, the hatch being removable from the body by sliding the hatch downwardly relative to the body; and a first mount disposed on the skirt and configured to receive the hatch in a closed position wherein the hatch covers said edge of the grinding disk; and a second mount disposed on the shroud and configured to receive the hatch in a storage position wherein the hatch does not cover said edge of the grinding disk.

2. The shroud of claim 1, wherein the grinder mount comprises a collar extending upwardly from the upper side of the body, the collar being configured for attachment to the body of an angle grinder.

3. The shroud of claim 2, wherein the collar has vertical slots formed therethrough.

4. The shroud of claim 1, wherein the body includes holes formed in the top thereof to allow some air flow through the top of the shroud.

5. The shroud of claim 1, wherein removal of the hatch exposes about five percent of the diameter of a grinding disk.

6. The shroud of claim 1, wherein the first mount holds the hatch in a position where the hatch forms a continuous part of the skirt.

7. The shroud of claim 1, wherein the hatch comprises tabs extending from the ends thereof and wherein the first mount comprises recesses formed in the bottom of the skirt to receive the tabs.

8. The shroud of claim 1, wherein the second mount is disposed on the upper surface of the body.

9. A dust shroud for an angle grinder comprising:

a generally circular body, the body having a generally flat upper surface and a skirt extending downwardly therefrom so as to form an interior cavity for generally enclosing the top and sides of a grinding disk;

a grinder mount for securing the shroud to an angle grinder so as to place the grinding disk within said interior cavity;

a vacuum port attached to the body and attachable to a vacuum hose, the vacuum port being disposed in fluid communication with the interior cavity such that a vacuum attached thereto draws air from around the grinding disk;

a selectively removable hatch formed on a side of the body such that removal of the hatch allows a grinding disk to protrude from an opening in the body, the hatch being removable from the body by sliding the hatch downwardly relative to the body;

a first mount formed at said opening and configured to selectively receive the hatch therein, the first mount being formed so as to position the hatch over said opening and enclose the grinding disk; and a second mount formed on the shroud and configured to selectively receive the hatch therein in a storage position such that the hatch does not cover said opening and such that a grinding disk protrudes from said opening.

10. The shroud of claim 9, wherein said second mount is disposed on the upper surface of the body.

11. The shroud of claim 9, wherein the hatch forms a continuous portion of the body when disposed in the first mount.

12. The shroud of claim 9, wherein the hatch has tabs extending therefrom, wherein the first mount has corresponding recesses formed in the bottom of the skirt to receive said tabs to thereby secure the hatch in the first mount, and wherein the second mount has corresponding recesses formed therein to receive said tabs to thereby secure the hatch in the second mount.

13. A method of using an angle grinder vacuum shroud comprising:

selecting an angle grinder having a vacuum shroud disposed thereon, the vacuum shroud having a shroud body with an upper surface and a skirt extending downwardly from the upper surface and away from the grinder and comprising a hatch on a side thereof, the hatch being selectively removable so as to selectively cover or expose an opening in the side of the shroud;

removing the hatch from the side of the shroud by sliding the hatch downwardly relative to the shroud body and away from the grinder in order to expose a side of a grinding disk such that the grinding disk protrudes from said opening so as to facilitate grinding with the grinding disk; and placing the hatch in a mount disposed on the top of the shroud so as to secure the hatch to the shroud while grinding.

14. The method of claim 13, wherein the method further comprises removing the hatch from the mount after grinding and securing the hatch to the side of the shroud so as to cover the side of the grinding disk.

15. The method of claim 13, wherein removing the hatch from the side of the shroud exposes about five percent of the grinding disk.

* * * * *